US005465538A

United States Patent [19]

Powers, Jr.

[11] Patent Number: 5,465,538

[45] Date of Patent: Nov. 14, 1995

[54] PREFABRICATED LINTEL

[76] Inventor: John Powers, Jr., 4118 E. Elwood St., Phoenix, Ariz. 85040

[21] Appl. No.: 116,618

[22] Filed: Sep. 7, 1993

[51] Int. Cl.[6] ..... E04C 5/12; E04C 5/18

[52] U.S. Cl. ..... 52/204.2; 52/213; 52/432; 52/433

[58] Field of Search ..... 52/85, 204.2, 211, 52/213, 216, 432, 433, 435, 566, 730.6

[56] References Cited

U.S. PATENT DOCUMENTS

| | | | |
|---|---|---|---|
| 468,296 | 2/1892 | Guastavino | 52/433 |
| 2,066,253 | 12/1936 | Davis | 52/204.2 |
| 2,325,614 | 8/1943 | Klaber | 52/204.2 |
| 4,020,612 | 5/1977 | Welch | 52/339 X |
| 4,757,656 | 7/1988 | Powers, Jr. | 52/204.2 |
| 5,138,808 | 8/1992 | Bengtson et al. | 52/204.2 |

FOREIGN PATENT DOCUMENTS

| | | | |
|---|---|---|---|
| 3318764 | 4/1984 | Germany | 52/433 |
| 203545 | 8/1989 | Japan | 52/432 |
| 91840 | 6/1958 | Norway | 52/432 |
| 931271 | 7/1963 | United Kingdom | 52/204.2 |

*Primary Examiner*—Carl D. Friedman
*Assistant Examiner*—Kevin D. Wilkens
*Attorney, Agent, or Firm*—Parsons & Associates; Don J. Flickinger; Robert A. Parsons

[57] ABSTRACT

A prefabricated lintel having two spaced apart parallel upstanding legs extending along the length of the lintel and having laterally aligned holes defined therethrough and spaced therealong. The lintel further has a flat lower surface and an upper surface defining flat, horizontal shoulders positioned along outer edges of the lintel on opposite sides of the upstanding legs and extending the length of the lintel. The lintel is placed to span a doorway and a course of blocks is laid on the flat shoulders, with a second course laid on the first course and a rebar positioned on the upper surface. A plurality of wire stirrups, each defining a rebar receiving loop, are engaged over the rebar and extend through openings in the two courses with end portions of the stirrups engaged in each of the holes defined in the upstanding legs of the lintel. The block openings are filled with grout.

13 Claims, 1 Drawing Sheet

27
30
20
27
50
2
2
25
17
19
12
15
10

34
37
46
45
32
43
25
36
42
41
40

52
4
30
50
20
4

32
27
53
46
34
42
45
43
25
59
60

17
57
15
63
62
27
55
66
30
27
53
53
20

PREFABRICATED LINTEL

BACKGROUND OF INVENTION

1. Field of the Invention

This invention relates to masonry construction of doorways.

More particularly, the present invention relates to the formation of the lintels of doorways in masonry construction.

In a further and more specific aspect, the instant invention concerns a prefabricated lintel and the use of the prefabricated lintel in the construction of masonry doorways.

2. Prior Art

In the prior art, the construction of doorways in masonry block walls is generally accomplished by forming the wall to approximately the desired height of the doorway while defining the sides of the doorway with upright lintel supports formed of the masonry blocks. An elongated flat piece of metal is placed between the supports to span the doorway. Courses of masonry blocks are then placed on the metal piece and the wall is completed. The problem is that all of the weight of the masonry blocks above the lintel are carried by the metal piece. Therefore, the maximum allowable length of the metal piece and, consequently, the size of the doorway, is severely limited. Even with the limitations of size, the metal piece must be extremely rugged and heavy.

In some prior art construction, the entire doorway, including the sides and in some instances the threshold, is constructed utilizing a preformed steel frame. One problem with this preformed steel frame is that it can only be purchased in predetermined sizes. Further, the preformed steel frame is extremely heavy and cumbersome to work with. Finally, the appearance of the preformed steel frame is not esthetically pleasing in most instances.

It would be highly advantageous, therefore, to remedy the foregoing and other deficiencies inherent in the prior art.

Accordingly, it is an object of the present invention to provide an improved lintel for doorways in masonry walls.

Another object of the present invention is to provide a prefabricated lintel.

And another object of the present invention is to provide a prefabricated lintel that can be used to form substantially any reasonably sized doorway in a masonry wall.

Still another object of the present invention is to provide a prefabricated lintel which is sturdier than prior art lintels.

Yet another object of the present invention is to provide a prefabricated lintel which is lighter than prior art lintels.

And still another object of the present invention is to provide a prefabricated lintel which is less expensive than prior art lintels.

A further object of the present invention is the provision of an improved method of forming doorways in masonry walls.

And a further object of the present invention is a method of forming improved doorways in masonry walls using the prefabricated lintel.

Still a further object of the present invention is a method of forming doorways in masonry walls with the prefabricated lintel, which method is simpler and provides a more rugged and esthetically pleasing doorway.

SUMMARY OF THE INVENTION

Briefly, to achieve the desired objects of the instant invention, in accordance with a preferred embodiment thereof, a prefabricated lintel is first provided including an elongated lintel with a predetermined length and at least one upstanding leg affixed thereto and extending substantially along the entire length of the lintel. The upstanding leg has holes defined therethrough and spaced therealong. The lintel further has a substantially flat lower surface and an upper surface defining substantially flat, horizontal shoulders positioned on either side of the upstanding leg and extending substantially the length of the lintel. The prefabricated lintel further includes a plurality of stirrups, with each stirrup of the plurality of stirrups having a rebar receiving opening therethrough and a portion engagable in each of the holes defined in the upstanding leg of the lintel.

In accordance with a further embodiment of the invention, a method of constructing a doorway in a masonry wall utilizing a prefabricated lintel is disclosed. The method includes the steps of forming a partial masonry wall and forming upright supports in the masonry wall on each side of and defining the doorway, the upright supports including a course of masonry having a flat upper surface at approximately a desired height for the doorway. Providing an elongated lintel with a predetermined length and two spaced apart parallel upstanding legs affixed thereto and extending substantially along the entire length of the lintel, the two upstanding legs having laterally aligned holes defined therethrough and spaced therealong, and the lintel further having a substantially flat lower surface, an upper surface defining substantially flat, horizontal shoulders positioned along outer edges of the lintel on opposite sides of the upstanding legs and extending substantially the length of the lintel. The method further includes the steps of supporting the lintel with the flat lower surface of the lintel on the flat upper surface of the upright supports and spanning the doorway and placing a first course of masonry on the flat upper surface of the upright supports and the horizontal shoulders of the lintel. A plurality of stirrups is provided, each stirrup of the plurality of stirrups including an elongated piece of wire formed into a continuous loop of wire having within a bight of the loop a rebar receiving opening therethrough, the piece of wire further having two end portions with each end portion being bent at an angle to engage one of the holes defined in one of the upstanding legs of the lintel, and opposite end portions of a stirrup being designed to engage laterally aligned holes in the two spaced apart upstanding legs. A stirrup is then engaged in each pair of laterally aligned holes in the two spaced apart parallel upstanding legs, a rebar is inserted through the bights of the plurality of stirrups, and the rebar is supported in vertical spaced relationship above the lintel by an additional course of masonry on the first course.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENTS

Figures 1, 2, 3, 4, 5:
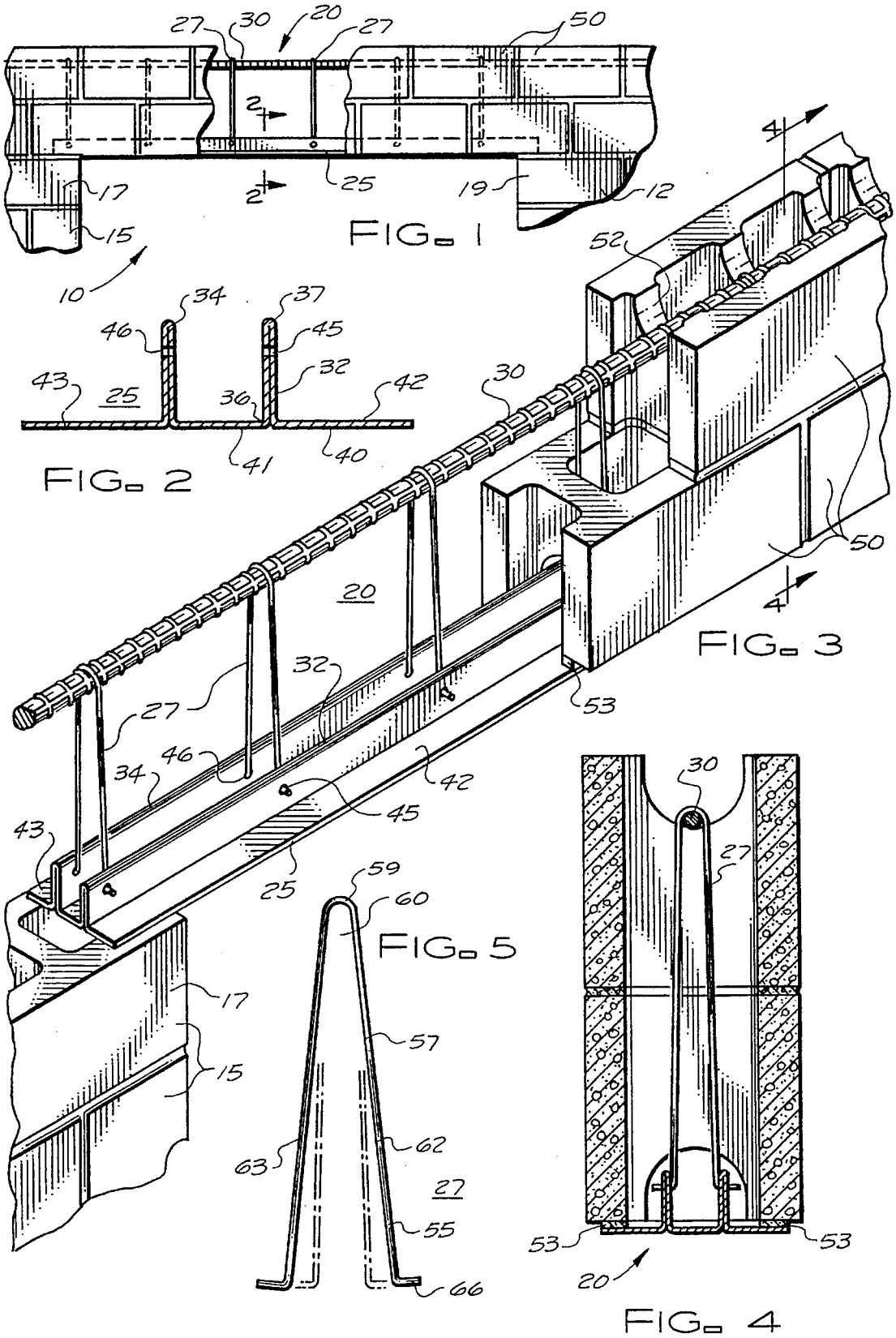
FIG. 1 is a front view of a masonry doorway, portions thereof broken away, utilizing an embodiment of a prefabricated lintel constructed in accordance with the present invention.
FIG. 2 is a cross-sectional view of the lintel as seen from the line 2—2 of FIG. 1.
FIG. 3 is an enlarged perspective view of the masonry doorway of FIG. 1, portions thereof removed to provide a better view of the construction.
FIG. 4 is an enlarged cross-sectional view of the prefabricated lintel as seen from the line 4—4 of FIG. 3.
FIG. 5 is an elevational view of a portion of the prefabricated lintel of FIG. 4 in an unstressed condition.

Turning now to the drawings in which like reference characters indicate corresponding elements, attention is first directed to FIG. 1 which illustrates a doorway 10 constructed in a masonry wall 12 in accordance with the present invention. Masonry wall 12 is formed of masonry blocks 15 which, in this embodiment are the type molded from concrete, but it will be understood that any of the well known masonry materials can be used. Generally, to form doorway 10, courses of masonry blocks 15 are laid to a height desired for doorway 12. With masonry wall 12 partially completed, upright supports 17 and 19 are formed which define the sides of doorway 10. Upright supports 17 and 19 are either formed by the edges of blocks 15 or by additional bearing material (not shown) which may be incorporated in a well known manner.

To complete doorway 10, a prefabricated lintel 20 is provided, which includes an elongated lintel 25, and a plurality of stirrups 27. A piece of rebar 30, or other hard, supporting rod-like material is also used, as will be explained presently. Lintel 25 is an elongated piece of material with a predetermined length and at least one upstanding leg affixed thereto and extending substantially along the entire length thereof. In this specific embodiment, lintel 25 is formed of an elongate flat sheet of steel having two upstanding legs 32 and 34 formed therein, but it will be understood that additional upstanding legs can be included if desired. Further, by referring to FIG. 2 it can be seen that in this specific embodiment upstanding leg 32 is formed by bending the steel sheet longitudinally at substantially a 90 degree bend, designated 36. A second, parallel, substantially 180 degree bend, designated 37, is formed and, finally, a third, parallel, substantially 90 degree bend is formed to complete upstanding leg 32. It should be noted that upstanding leg 34 is formed in the same fashion. Thus, lintel 25 is formed with a flat base portion 40 having a substantially flat lower surface 41 and an upper surface defining substantially flat, horizontal shoulders 42 and 43 positioned on either side of integral upstanding legs 32 and 34. Upstanding legs 32 and 34 extend substantially the length of lintel 25. Further, the length of lintel 25 can be formed substantially any desired length, predetermined by the size of doorway 10, by simply forming lintel 25 in a continuous length and cutting it to the predetermined length. It will, of course, be understood by those skilled in the art that the disclosed lintel incorporates one preferred method of forming lintel 25 and other methods and structures will occur, as for example, utilizing angle and/or U-channel irons to provide the upstanding legs and the shoulders.

Upstanding legs 32 and 34 each have a plurality of holes 45 and 46, respectively, defined therethrough and spaced therealong. Holes 45 and 46 may be formed by any convenient method, such as drilling, etc. Further, it should be noted that holes 45 and 46 are laterally aligned so as to conveniently receive stirrups 27 therein and are conveniently spaced so that stirrups 27 extend through vertical openings, or air spaces, in masonry blocks 15, as will be explained presently.

Lintel 25 is placed so as to span doorway 10 with flat surface 41 at the ends thereof lying on the upper surface of upright supports 17 and 19, as can be seen in FIGS. 1 and 3. A plurality of modified masonry blocks 50 are provided, Masonry blocks 50 are similar to masonry blocks 15 in that they are the type having opposed vertical sidewalls, or faces, and a plurality of vertical openings, or air spaces, extending therethrough formed by webbing extending horizontally between the vertical sidewalls. Modified masonry blocks 50 have a channel 52 extending from one end to the other between opposite faces thereof. Essentially, masonry blocks of this type can be purchased or they can be formed by simply removing a portion of the webbing. In this specific embodiment, modified masonry blocks 50 are formed with a single channel 52 along one edge, for reasons which will become apparent presently.

With lintel 25 in place, a first course of masonry blocks 50 is laid with channel 52 directed downwardly so that upstanding legs 32 and 34 of lintel 25 are received within channel 52 and the lower surface of the sidewalls, or faces, rests on shoulders 42 and 43. A thin layer 53 of mortar or other sealing material is placed on shoulders 42 and 43 before laying masonry blocks 50 thereon. Layer 53 seals the juncture of shoulders 42 and 43 with masonry blocks 50 and prevents relative movement, as well as water and the like from exiting between the lower surface of masonry blocks 50 and shoulders 42 and 43. Here it will be understood that the entire course of masonry blocks along wall 12 need not be formed with modified masonry blocks 50, since masonry blocks 15 will be acceptable once the course extends beyond lintel 25.

With the first course in place, a second course is started, generally outwardly from upright supports 17 and 19 and the laying of masonry blocks 50 will proceed inwardly toward the center of lintel 25. In the second course, modified masonry blocks 50 are utilized in a reverse position, that is, channel 52 is positioned in an upwardly directed orientation. Once this point in the construction is reached, there are a variety of ways to proceed and those skilled in the art will determine the most convenient for the specific application. In this specific method, one or more masonry blocks 50 are laid at the outer ends of lintel 25 and rebar 30 is positioned in channels 52. Plurality of stirrups 27 are then engaged, one stirrup at a time.

Each stirrup 27 is formed of a hard wire or rod-like material which can be bent into the desired shape and which, preferably, has some spring or resiliency. In this preferred embodiment, stirrups 27 are formed of 9 gage steel wire. Referring specifically to FIG. 5, a single stirrup 27 is illustrated. Stirrup 27 is formed of an elongated piece of wire 55 formed into a continuous loop 57 (illustrated as a generally inverted V-shape), with a bight 59 of loop 57 forming a rebar receiving opening 60 therethrough. Loop 57 of piece of wire 55 further extends into legs 62 and 63, each terminating in an end portion 66 and 67, respectively. Each end portion 66 and 67 of legs 62 and 62 are bent at an angle (approximately 90 degrees) to engage one of the holes 45 or 46 defined in upstanding legs 32 and 34 of lintel 25. Opposite end portions 66 and 67 of stirrup 27 are designed to engage laterally aligned holes 45 and 46 in the two spaced apart upstanding legs 32 and 34. With rebar 30 in the position illustrated in FIGS. 3 and 4, each individual stirrup 27 is inserted over rebar 30 into a vertical opening in one of masonry blocks 50. Rebar 30 is received in opening 60 of bight 59, legs 62 and 63 are compressed together, as illustrated in broken lines in FIG. 5 and in solid lines in FIG. 4, and end portions 66 and 67 are inserted in a pair of laterally aligned openings 45 and 46. While stirrups 27 are formed so that end portions 66 and 67 extend outwardly from legs 62 and 63, it will be understood that stirrups 27 could also be formed so that end portions 66 and 67 extend inwardly, in which instance legs 62 and 63 would be spread apart to insert end portion 62 and 63 into openings 45 and 46. In either instance, it is desirable for stirrup 27 to have some spring or resiliency so that once positioned it is held firmly in place.

The first and second courses of masonry blocks 50 are completed on lintel 25 and all of the plurality of stirrups 27 are positioned in vertical openings in masonry blocks 50. The vertical openings through masonry blocks 50 are then filled with a grout (not shown), generally so that the level of grout is even with the upper surface thereof and rebar 30 is covered and incorporated into the system. In this embodiment a 3000 P.S.I. grout is utilized and sufficient stirring or vibrating is performed to insure that all air pockets are filled. In this fashion, lintel 25, rebar 30, stirrups 27, masonry blocks 50 and the grout in the openings cooperate to form a solid lintel system which is extremely strong, even though the individual components are relatively small, light and easy to work with. Further, the lintel system is relatively inexpensive and can be formed at substantially any reasonable length without requiring special manufacturing or components. In addition, the lintel system can be constructed utilizing a variety of materials so that it will be esthetically pleasing.

Various modifications and changes to the embodiments herein chosen for purposes of illustration will readily occur to those skilled in the art. For example, lintel 25 can be formed in a variety of ways while still performing the stated functions. Further, a variety of different masonry materials may be utilized and the walls may be fabricated in a variety of somewhat modified and/or interchanged steps.

The foregoing is given by way of example only. Other modifications and variations may be made by those skilled in the art without departing from the scope of the invention as defined by the following claims.

Having fully described and disclosed the present invention and preferred embodiments thereof in such clear and concise terms as to enable those skilled in the art to understand and practice same, the invention claimed is:

1. A prefabricated lintel comprising:

an elongated lintel with a predetermined length and at least one upstanding leg affixed thereto and extending substantially along the entire length of the lintel, said at least one upstanding leg having holes defined therethrough and spaced therealong, the lintel further having a substantially flat lower surface and an upper surface defining substantially flat, horizontal shoulders positioned on either side of said at least one upstanding leg and extending substantially the length of the lintel; and a plurality of stirrups, each stirrup of the plurality of stirrups having a rebar receiving opening therethrough and a portion engageable in each of the holes defined in said at least one upstanding leg of the lintel, said stirrups are formed of wire with a first bend designed to engage one of said holes in said at least one upstanding leg and a second bend forming said rebar receiving opening.

2. A prefabricated lintel as claimed in claim 1 wherein the stirrup is formed of at least 9 gage steel wire.

3. A prefabricated lintel comprising:

an elongated lintel with a predetermined length and at least one upstanding leg affixed thereto and extending substantially along the entire length of the lintel, said lintel formed of an elongate flat sheet of steel and the sheet includes a substantially 90 degree bend, a substantially 180 degree bend and a substantially 90 degree bend to form said at least one upstanding leg, said at least one upstanding leg having holes defined therethrough and spaced therealong, the lintel further having a substantially flat lower surface and an upper surface defining substantially flat, horizontal shoulders positioned on either side of said at least one upstanding leg and extending substantially the length of the lintel; and a plurality of stirrups, each stirrup of the plurality of stirrups having a rebar receiving opening therethrough and a portion engageable in each of the holes defined in said at least one upstanding leg of the lintel.

4. A prefabricated lintel comprising:

an elongated lintel with a predetermined length and two spaced apart parallel upstanding legs affixed thereto and extending substantially along the entire length of the lintel, the two upstanding legs having laterally aligned holes defined therethrough and spaced therealong, the lintel further having a substantially flat lower surface, an upper surface defining substantially flat, horizontal shoulders positioned along outer edges of the lintel on opposite sides of the upstanding legs and extending substantially the length of the lintel; and a plurality of stirrups, each stirrup of the plurality of stirrups including an elongated piece of wire formed into a continuous loop of wire having within a bight of the loop a rebar receiving opening therethrough, the piece of wire further having two end portions with each end portion being bent at an angle to engage one of the holes defined in one of the upstanding legs of the lintel, opposite end portions of a stirrup being designed to engage laterally aligned holes in the two spaced apart upstanding legs.

5. A prefabricated lintel as claimed in claim 4 wherein the stirrup is formed of steel wire having some spring or resiliency.

6. A prefabricated lintel as claimed in claim 5 wherein the continuous loop of wire is formed with a bight and two spaced apart legs, each of the two end portions being positioned at the end of a different one of the legs with the end portions being bent so as to extend outwardly from the legs in opposite directions.

7. A method of constructing a doorway in a masonry wall utilizing a prefabricated lintel comprising the steps of:

forming a partial masonry wall;

forming upright supports in the masonry wall on each side of and defining the doorway, the upright supports including a course of masonry having a flat upper surface at approximately a desired height for the doorway;

providing an elongated lintel with a predetermined length and two spaced apart parallel upstanding legs affixed thereto and extending substantially along the entire length of the lintel, the two upstanding legs having laterally aligned holes defined therethrough and spaced therealong, and the lintel further having a substantially flat lower surface, an upper surface defining substantially flat, horizontal shoulders positioned along outer edges of the lintel on opposite sides of the upstanding legs and extending substantially the length of the lintel;

supporting the lintel with the flat lower surface of the lintel on the flat upper surface of the upright supports and spanning the doorway;

placing a first course of masonry on the flat upper surface of the upright supports and the horizontal shoulders of the lintel;

providing a plurality of stirrups, each stirrup of the plurality of stirrups including an elongated piece of wire formed into a continuous loop of wire having within a bight of the loop a rebar receiving opening therethrough, the piece of wire further having two end portions with each end portion being bent at an angle to engage one of the holes defined in one of the upstanding legs of the lintel, and opposite end portions of a stirrup being designed to engage laterally aligned holes in the two spaced apart upstanding legs;

engaging a stirrup in each pair of laterally aligned holes in the two spaced apart parallel upstanding legs and inserting a rebar through the bights of the plurality of stirrups; and supporting the rebar in vertical spaced relationship above the lintel by an additional course of masonry on the first course.

8. A method of constructing a doorway in a masonry wall utilizing a prefabricated lintel as claimed in claim 7 wherein the steps of forming upright supports, placing the first course and supporting the rebar by an additional course include utilizing masonry blocks.

9. A method of constructing a doorway in a masonry wall utilizing a prefabricated lintel as claimed in claim 8 wherein the step of utilizing masonry blocks includes utilizing masonry blocks of the type having vertical sidewalls and a plurality of vertical openings extending through the masonry blocks.

10. A method of constructing a doorway in a masonry wall utilizing a prefabricated lintel as claimed in claim 9 wherein the rebar is supported by the masonry blocks and the step of engaging a stirrup in each pair of laterally aligned holes includes extending the stirrups vertically through the openings through the masonry blocks.

11. A method of constructing a doorway in a masonry wall utilizing a prefabricated lintel as claimed in claim 10 wherein the step of placing a first course of masonry on the flat upper surface of the upright supports and the horizontal shoulders of the lintel includes providing masonry blocks having a channel extending from one end of each masonry block to the other between opposite faces of the masonry block, and positioning the masonry blocks on the lintel with the faces bearing on the horizontal shoulders of the lintel and the two upstanding legs positioned in the channel.

12. A method of constructing a doorway in a masonry wall utilizing a prefabricated lintel as claimed in claim 11 wherein the step of supporting the rebar in vertical spaced relationship above the lintel by an additional course of masonry on the first course includes providing masonry blocks having a channel extending from one end of each masonry block to the other between opposite faces of the masonry block, laying the additional course of masonry blocks on the first course with the channel opening upwardly, laying the rebar in the channel, positioning the plurality of stirrups with the bight over the rebar, and engaging opposite end portions of each stirrup in each pair of laterally aligned holes in the two spaced apart parallel upstanding legs.

13. A method of constructing a doorway in a masonry wall utilizing a prefabricated lintel as claimed in claim 10 including in addition the step of filling at least the vertical openings having stirrups extending therethrough with grout.

* * * * *